US006234341B1

(12) United States Patent
Tattam

(10) Patent No.: US 6,234,341 B1
(45) Date of Patent: May 22, 2001

(54) THERMALLY INSULATED CONTAINER

(76) Inventor: Edwin Francis Tattam, Magpies, Grubbins Lane, Speen, Bucks, HP27 OSH (GB)

( * ) Notice: Subject to any disclaimer, the term of this patent is extended or adjusted under 35 U.S.C. 154(b) by 0 days.

(21) Appl. No.: 09/508,756

(22) PCT Filed: Jul. 12, 1999

(86) PCT No.: PCT/GB99/02225

§ 371 Date: Mar. 16, 2000

§ 102(e) Date: Mar. 16, 2000

(87) PCT Pub. No.: WO00/03931

PCT Pub. Date: Jan. 27, 2000

(30) Foreign Application Priority Data

Jul. 17, 1998 (GB) ..... 9815474

(51) Int. Cl.[7] ..... B65D 81/38

(52) U.S. Cl. ..... 220/592.25; 220/592.03; 220/592.26

(58) Field of Search ..... 220/592.03, 592.09, 220/592.1, 592.2, 592.25, 592.26, 1.5, 592.01, 588, 586, 611, 612, 613, 678, 62.22

(56) References Cited

U.S. PATENT DOCUMENTS 2,803,368 * 12/1957 Koch .
3,139,206 * 6/1964 Matsch .
3,472,568 * 10/1969 Southwick .
3,888,557 * 6/1975 Anderson et al. ..... 312/409
4,377,075 3/1983 Russo .
4,862,674 9/1989 Lejondahl et al. .
5,009,952 * 4/1991 Klepsch et al. ..... 428/319.1

FOREIGN PATENT DOCUMENTS 3743372A 6/1989 (DE) .
WO 80/01791A 9/1980 (EP) .
0157751A 10/1985 (EP) .
2419884A 10/1979 (FR) .
610559A 10/1948 (GB) .
1403771A 8/1975 (GB) .
1482325A 8/1977 (GB) .
2235523A 3/1991 (GB) .
2262155A 6/1993 (GB) .

* cited by examiner

*Primary Examiner*—Stephen Castellano
(74) *Attorney, Agent, or Firm*—Fleshner & Kim, LLP

(57) ABSTRACT

A transport container comprises an insulating block. A plurality of layers of flexible insulating foam material form sides of the container and are mounted on the block which closes one end of the container. A pressure envelope applies pressure around the exterior of the sides and the block.

15 Claims, 4 Drawing Sheets

THERMALLY INSULATED CONTAINER

TECHNICAL FIELD

This invention relates to a transport container for use in transporting temperature sensitive products and keeping them either cool or protecting them from chilling in transit, as required.

BACKGROUND ART

Certain products need to be kept cool whilst being transported from place to place by postal or courier services, particularly from a manufacturer or distributor to a consumer for the product concerned. Examples of such products are food products, pharmaceuticals and bio-chemicals including diagnostics, and they are generally known as "cold chain" products. Other products need to be protected from chilling during transport, particularly from freezing in air cargo, and in this specification these products are referred to as "warm" products. Examples of "warm" products include certain other foodstuffs and pharmaceuticals, and blood products.

"Cold chain" and "warm" products have until now generally been transported in thermally insulated rigid containers such as fabricated polystyrene foam boxes as an example, but such containers can be fragile, expensive and inefficient.

It is an object of the present invention to provide an improved transport container.

DISCLOSURE OF INVENTION

In accordance with the present invention, a transport container comprises an insulating block, a plurality of layers of flexible insulating foam material forming sides of the container and mounted on the block which closes one end of the container, and a pressure envelope for applying pressure around the exterior of the sides and the block.

Preferably the pressure envelope is a heat shrunk polyethylene envelope.

Preferred also the insulating block is formed from stiff polyethylene foam.

Preferred also the sides of a plurality of layers of said flexible insulating material at least one sheet of said flexible insulating material wound a plurality of times around itself to form said plurality of layers.

Preferred further said at least one sheet of said flexible insulating material is wound a plurality of times around itself and around at least a portion of the insulating block.

Preferred further at least a portion of the insulating block is attached to at least the outer edge of the outer layer of the plurality of layers of said flexible insulating material at said one end of the container.

Preferred further said at least one sheet of said flexible insulating material is wound a plurality of times around itself and around at least a portion of the insulating block, and another portion of the insulating block is attached to at least the outer edge of the outer layer of the plurality of layers of said flexible insulating material at said one end of the container.

Preferred further the insulating foam material is of closed-cell low-density polyethylene.

Preferred further at least one of said plurality of layers is attached to the block by heat-bonding, or by adhesive, or by the use of adhesive tape.

Preferred further a strip of adhesive tape lapping over both said outer edge and a portion of the insulating block all the way around the block attaches the sides of the container to the block.

Preferred further the container includes closure means for closing the other end of the container.

Preferred further said closure means comprises a further insulating block to be attached to the sides to close the other end of the container.

Preferred further the transport container contains dry ice and a product to be transported in the transport container.

Preferred further the closed cells in at least the inner layer of the plurality of layers of the sides of the container are pressurised and expanded in the plane of the inner layer by the carbon dioxide gas sublimed from the dry ice.

The present invention also in a transport which has been used for transporting a product and has contained dry ice, wherein any closure means has been opened, the block has been removed, the sides have been flattened and at least the inner layer of the plurality of layers of the sides of the container has been thinned.

Other preferred features of the invention will be apparent from the following description and from the subsidiary claims of the specification.

BRIEF DESCRIPTION OF THE DRAWINGS

The invention will now be further described, merely by way of example, by reference to the accompanying drawings, in which.

BEST MODE OF INVENTION

Figure 1:
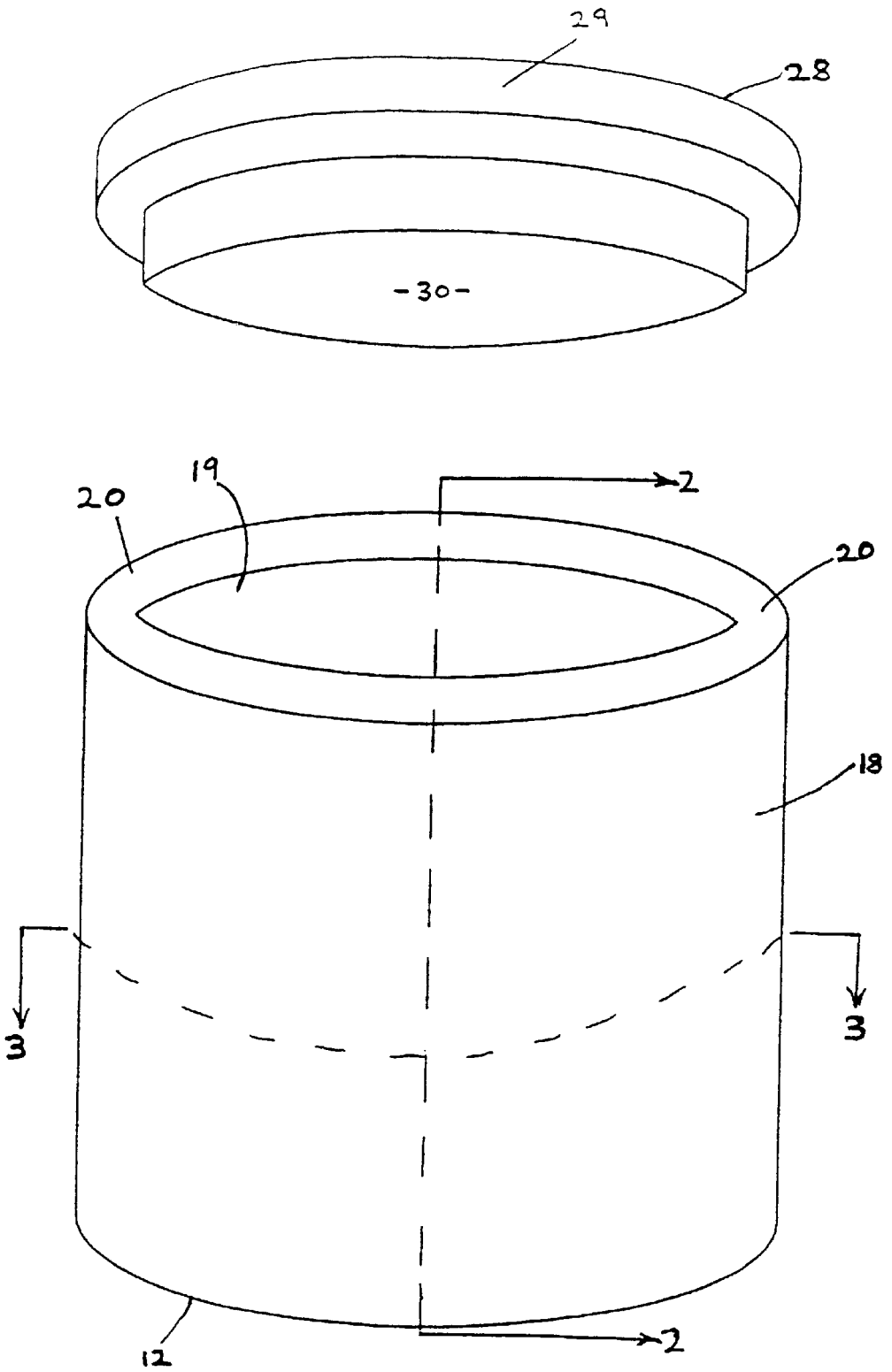
FIG. 1 is a perspective view of a transport container according to a preferred example of the invention, including its closure.
Figure 2:
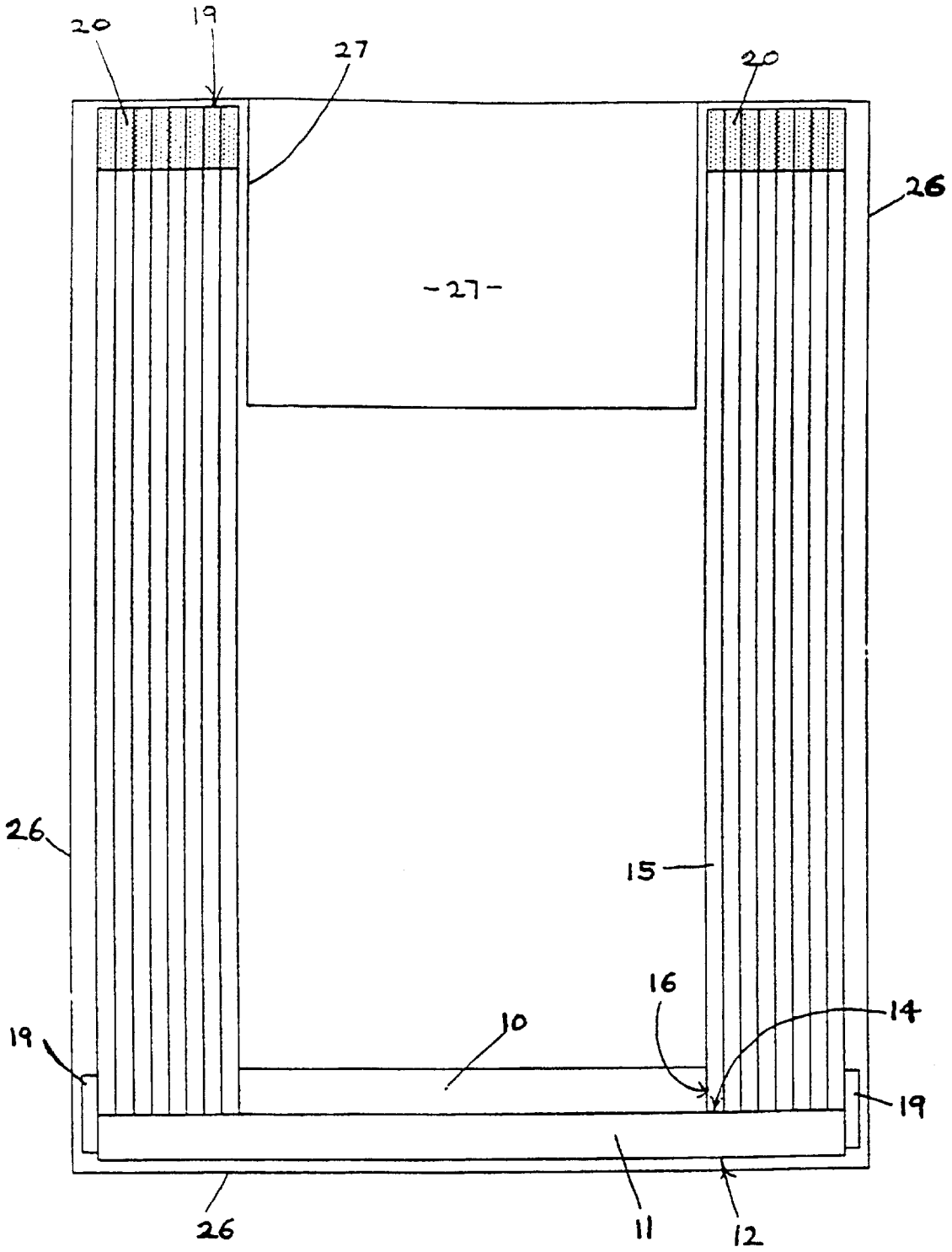
FIG. 2 is a cross-sectional view taken on the plane 2—2 on FIG. 1.
Figure 3:
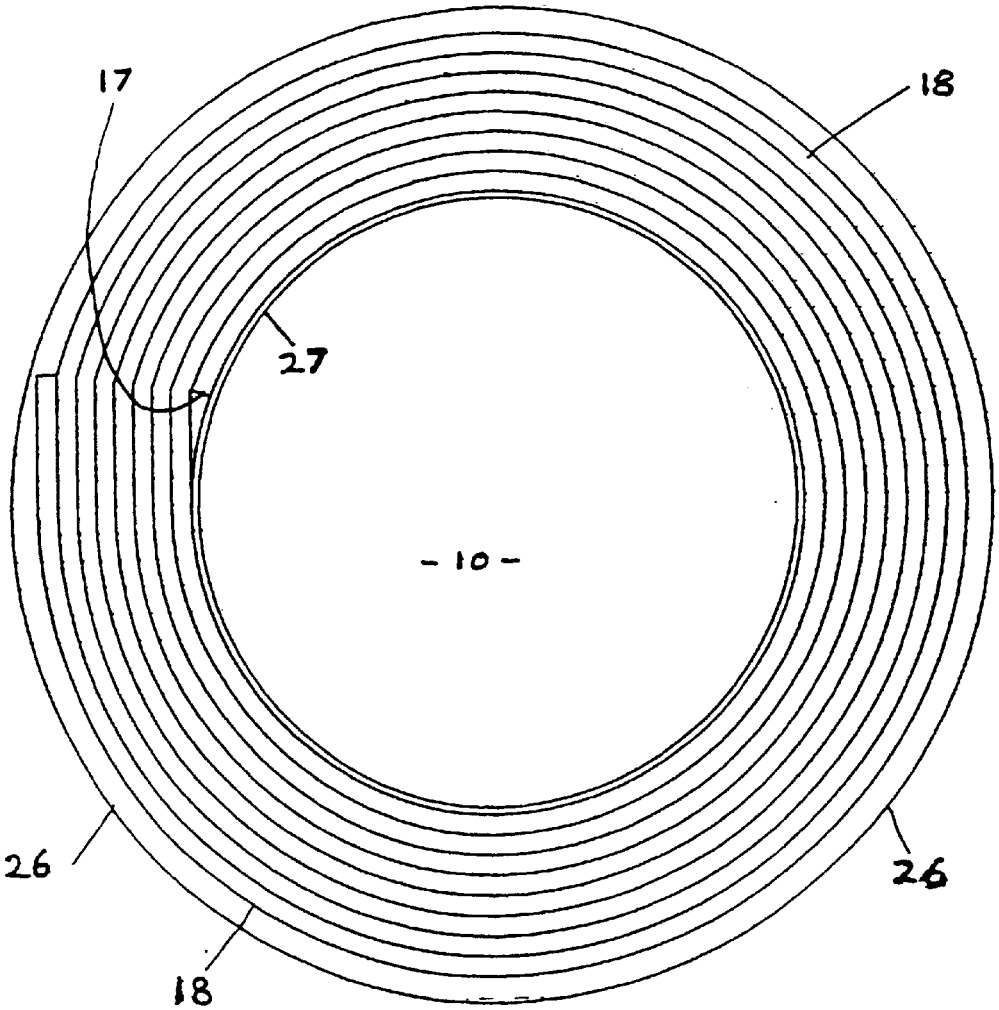
FIG. 3 is a cross-sectional view taken on the plane 3—3 on FIG. 1.

Referring initially to FIGS. 1–3 in the preferred example of the invention, a rigid circular disc 10 some 12 mm thick of polyethylene foam is glued coaxially on one side of another disc 11 of the same foam but of larger diameter to form a block 12 of T-shaped cross-section for a transport container 13. The projection of the edge of the larger diameter disc 11 beyond the edge of the smaller diameter disc 10 constitutes a flange 14. If required, the block 12 can be formed integrally in the same shape as that just described.

A single sheet 15 of flexible low-density polyethylene closed-cell insulating foam material as one edge 16 wound around the edge of the disc 10 and seating against the flange 14. When the edge 16 of the sheet 15 has been wound all of the way around the edge of the disc 10, it has returned to its starting point 17, and winding then continues around the outside of the already-wound sheet and many more times to build up a multi-layered roll 18 of approximately circular cross-section of a plurality of layers of the sheet 15 of flexible insulating foam material. The roll 18 forms the sides of the transport container 13. FIGS. 2 and 3 show eight layers in the multi-layered roll 18, but either more or less layers can be used.

The last layer is approximately flush with the edge of the disc 11 and is attached to it by a length of adhesive tape 19 extending around the edge of the disc 11 and also lapping over the outer edge of the roll 18. The tape 19 is shown in FIG. 2 only. Alternatively the edge 16 of the sheet 15 is attached by bonding to the edge of the disc 11 and the flange 14, and the edges 16 of each of the layers of the roll 18 are bonded together and to the flange 14. Bonding is achieved by adhesive or by heat sealing using a jet of hot air at a temperature of greater than 120 degrees Celsius. The block 12 closes one end of the container 13. The other end 19 of the container 13 is open, and the adjacent edges 20 of the layers of the sheet may be bonded together if required.

The block 12 and the roll 18 attached to it are inserted in a heat-shrinkable polyethylene pressure envelope 26 with the block 12 in the closed-end of the envelope 26 and the wall of the envelope 26 extending along the roll 18 and tucked at 27 into the end 19 of the container. The envelope is omitted from FIG. 1, but shown in FIGS. 2 and 3. The polyethylene envelope 26 is initially a loose fit over the block 12 and the roll 18 as shown in FIGS. 2 and 3 for clarity, and is subsequently heat-shrunk to apply pressure to grip tightly onto the roll 18 and underneath the block 12, principally to reinforce the attachment of the block 12 to the roll 18 during the filling of the container 13 and during its subsequent handling and transport. The envelope 26 also reinforces the end 19 of the container 13 and the adjacent edges 20 of the layers of the sheet 15. The part 27 of the envelope 26 inside the roll 18 does not shrink, but remains highly flexible.

It will be appreciated that all of the components of the transport container 13 described thus far, ie. the block 12, the roll 18 and the envelope 26, are made of polyethylene, which facilitates recycling and disposal of the container 13 after use, but if desired the pressure envelope 26 may be of a different material, for example an elastomeric material.

The container 13 is provided with a closure 28, shown in FIG. 1 only, which is of the same construction, shape and size as the block 12. Thus the closure 28 comprises a large diameter disc 29 which fits as a cap on the end 19 of the roll 18, and a coaxial small diameter disc 30 which fits snugly into the end 19. The projection of the large disc 29 beyond the small disc 30 constitutes a flange which seats on the envelope 26 where it passes over the edges 20 of the layers of the sheet 15.

In use the transport container 13 can be stood on end on the block 12 in a stable position to be filled, or can be filled lying on its side if this is convenient, the combination of the block 12, the multi-layered roll 18 and the pressure envelope 26 giving the container 13 substantial rigidity. The closure 28 is then fitted in place and secured as required, for example by adhesive or by adhesive tape around the container lapping over the adjacent edges of the closure 28 and the envelope 26. The container 13 can be labelled for shipping or put in a labelled shipping bag.

The contents of the transport container 13 may vary between the following types, as follows:

1. For a cold chain product to be kept as cold as possible during transport, the pre-chilled product is placed in the container 13 with the desired quantity (perhaps two Kgs) of "dry ice", which is frozen carbon dioxide, in granulated, sliced or chunk form.
2. For a cold chain product to be kept cool, but not frozen, for example at 0 to 8 degrees Celsius, the pre-chilled product is placed in the container with a closed shell of flexible low-density polyethylene closed-cell insulating foam which contains a refrigerant. The refrigerant may be dry ice or a frozen ice mat of polyethylene sheet having pockets containing a frozen aqueous solution of polyethylene glycol. The refrigerant keeps the product cold for a long time, but the insulation of the shell between the refrigerant and the product stops the product from being chilled too much by the refrigerant.
3. For a warm product, the product is placed in the container on its own, or wrapped in additional insulation, or with a closed shell of flexible containing a warmed ice mat of the same construction as described above, but heated to, for example, 20 to 30 degrees Celsius.

When dry ice is used as a refrigerant, this sublimes to carbon dioxide gas at a substantial pressure which percolates molecularly into the closed cells of the polyethylene foam and any layer-to-layer spaces in the roll 18 where it chills the cell walls to its temperature. The carbon dioxide gas is also believed, without prejudice to the present invention, to pressurise and expand the cells of at least the innermost layer of the roll 18. The outer layers of the roll 18 and the envelope 26 keep the expanded cells within the original thickness of the layer concerned, so that the expansion of the cells is also believed to be two-dimensional in the plane of the layers concerned, and to damage the cell walls. When the dry ice has sublimed away, that inner layer or layers is found to have lost most of its substance and resilience and to be thinner than it was, which reduces the bulk of the container for disposal or recycling.

The used container is readily recycled or disposed of because the block 12 can be quickly be detached from the roll 18 by slitting the envelope 26 around the block, and then breaking the attachment between the block 12 and the roll 18, followed by flattening the roll 18. This is readily done even if the roll contains a polyethylene foam shell or a polyethylene ice mat; all components are of polyethylene. The thinning of at least the inner layer of the roll 18 also reduces the bulk of the container prepared for recycling.

It will be appreciated that polyethylene foam is inexpensive in comparison with fabricated polystyrene, gives good protection from mechanical shock and poor handling, and is easy to recycle.

Figure 4:
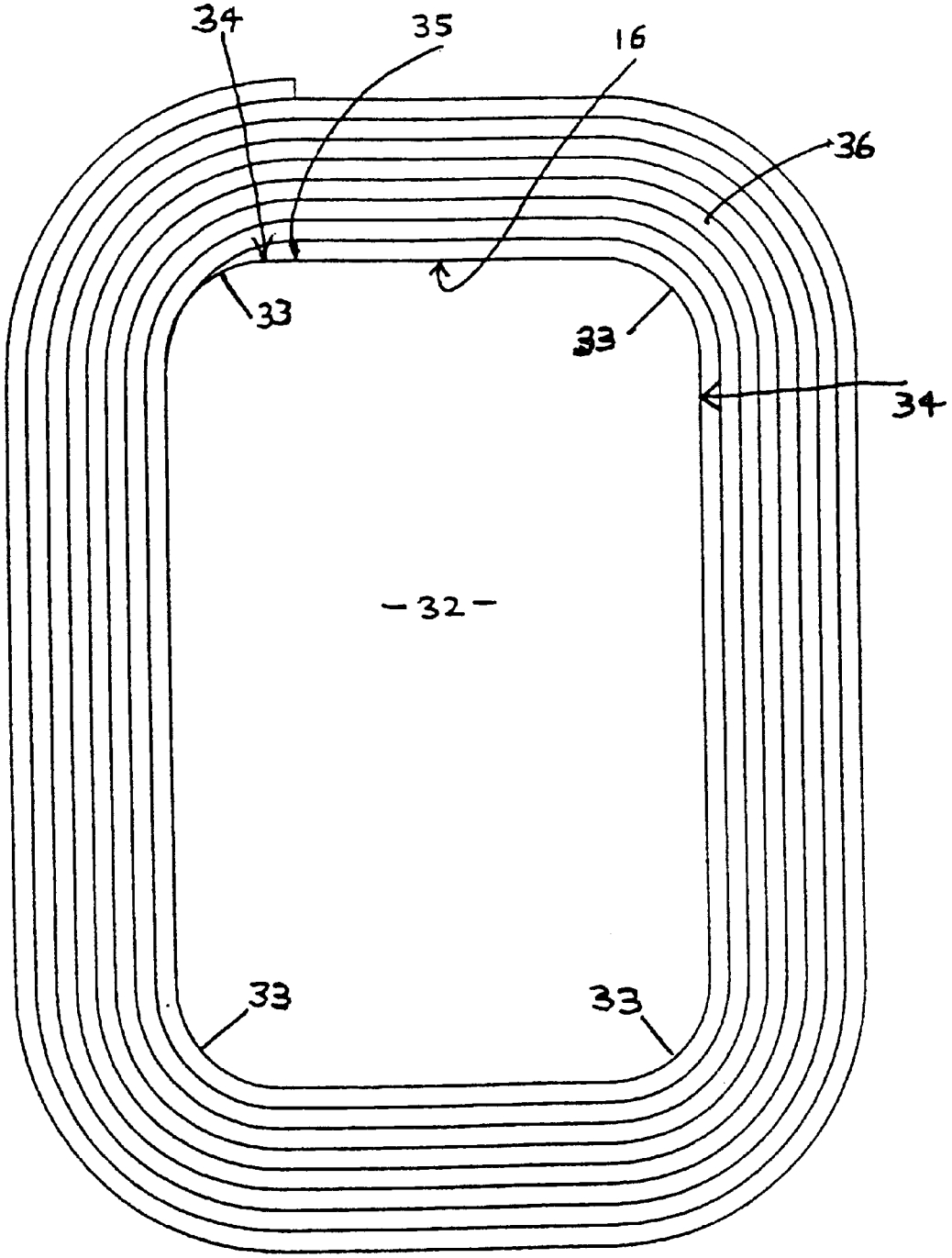
FIG. 4 is a view similar to FIG. 3, but showing a modification of the preferred example.

Referring now to FIG. 4 of the drawings, in a modification of the preferred example, the block 12 described above has been modified to be a rectangular block 32 which has its corners rounded off at 33.

The block 32 has a substantially rectangular cross section rather than a T-shaped cross section like block 12.

The single sheet 15 described above has one edge 15 wound around the edge 34 of the block 32 from a starting point 35, many times around the block 32 and then around itself to build up a multi-layered roll 36 of approximately rectangular cross-section, as clearly seen in FIG. 4. The edge 16 is attached to the block 32 by adhesive, or double-sided adhesive tape, or by the use of a hot-air gun as the winding proceeds, and this bonding continues after the starting point 35 has been passed to bond each successive layer of the multi-layered roll 36 to its preceding layer. Such bonding also takes place at the edge of the sheet 15 opposite the edge 16 and the block 32 to secure the roll 36 together.

The block 32 and roll 36 are inserted in a pressure envelope (not shown) in the same way as in the preferred example, which stops the block 32 from being pushed out from the end of the roll which it closes. The envelope is preferably of polyethylene and is heat-shrunk in situ to apply pressure to the block 32 and roll 36.

When the transport container of this modification has been filled with the product to be transported and any refrigerant that is required, it is closed by having its end opposite the block 32 pressed together in a linear closure, and is held in place by a strip of double-sided adhesive tape just inside and around that end.

What is claimed is:

1. A transport container comprising an insulating block;

a plurality of layers of flexible insulating foam material forming sides of the container and mounted on the insulating block, which closes one end of the transport container;

a heat-shrunk pressure envelope that applies pressure around the exterior of the sides and the block.

2. The transport container according to claim 1, wherein the heat-shrunk pressure envelope is a heat-shrunk polyethylene envelope.

3. The transport container according to claim 1, wherein the insulating block is formed from stiff polyethylene foam.

4. The transport container according to claim 1, wherein sides of the plurality of layers of flexible insulating foam material comprise at least one sheet of said flexible insulating foam material wound a plurality of times around itself to form said plurality of layers of flexible insulating foam material.

5. The transport container according to claim 4, wherein said at least one sheet of said flexible insulating foam material is wound a plurality of times around itself and around at least a portion of the insulating block.

6. The transport container according to claim 4, wherein at least a portion of the insulating block is attached to at least an outer edge of an outer layer of the plurality of layers of flexible insulating foam material at said one end of the transport container.

7. The transport container according to claim 5, wherein said at least one sheet of said flexible insulating foam material is wound a plurality of times around itself and around at least a portion of the insulating block, and another portion of the insulating block is attached to at least an outer edge of an outer layer of the plurality of layers of flexible insulating foam material at said one end of the transport container.

8. The transport container according to claim 1, wherein the flexible insulating foam material is of closed-cell low-density polyethylene.

9. The transport container according to claim 8, wherein at least one of said plurality of layers of flexible insulating foam material is attached to the insulating block by at least one of heat-bonding, adhesive, or adhesive tape.

10. The transport container according to claim 5, wherein a strip of adhesive tape configured to over both said outer edge of an outer layer of the plurality of layers of said flexible insulating foam material and a portion of the insulating block all the way around the insulating block attaches the sides of the transport container to the insulating block.

11. The transport container according to claim 1, further comprising closure means for closing the other end of the transport container.

12. The transport container according to claim 11, wherein said closure means comprises a further insulating block configured to be attachable to the plurality of layers of flexible insulating foam material to close the other end of the transport container.

13. The transport container according to claim 1, wherein the transport container is configured to transport dry ice and a product to be transported.

14. The transport container according to claim 1, wherein the closed cells in at least an inner layer of the plurality of layers of the flexible foam insulating material forming the sides of the transport container are pressurized and expanded in a plane of the inner layer by carbon dioxide gas sublimed from the dry ice.

15. The transport container according to claim 1, wherein the flexible insulating foam material is of closed-cell low-density polyethylene, and the transport container is configured to transport dry ice and a product to be transported.

* * * * *